US005569575A

United States Patent [19]

Yamashita

[11] Patent Number: 5,569,575

[45] Date of Patent: Oct. 29, 1996

[54] PROCESSING METHOD OF A SILVER HALIDE PHOTOGRAPHIC MATERIAL

[75] Inventor: Hirobumi Yamashita, Hino, Japan

[73] Assignee: Konica Corporation, Tokyo, Japan

[21] Appl. No.: 386,636

[22] Filed: Feb. 10, 1995

[30] Foreign Application Priority Data

Feb. 18, 1994 [JP] Japan ..... 6-021277

[51] Int. Cl.[6] ..... G03C 5/31

[52] U.S. Cl. ..... 430/399; 430/963

[58] Field of Search ..... 430/399, 963

[56] References Cited

U.S. PATENT DOCUMENTS

| | | | |
|---|---|---|---|
| 5,001,046 | 3/1991 | Honda et al. | 430/963 |
| 5,089,379 | 2/1992 | Yatsuyanagi | 430/963 |
| 5,348,850 | 9/1994 | Yoshida | 430/963 |
| 5,382,507 | 1/1995 | Shimizu et al. | 430/399 |
| 5,405,732 | 4/1995 | Shimizu et al. | 430/264 |

FOREIGN PATENT DOCUMENTS

| | | |
|---|---|---|
| 0514675A1 | 11/1992 | European Pat. Off. . |
| 0607912A2 | 7/1994 | European Pat. Off. . |
| 0608119A2 | 7/1994 | European Pat. Off. . |
| 0642055A1 | 3/1995 | European Pat. Off. . |
| 5-289223 | 5/1993 | Japan . |

OTHER PUBLICATIONS

Derwent Publications Ltd., "Silver halide photographic material for laser light source—includes specified cyanine dyes as spectral sensitisers, with overcoat containing fluoro substituted anionic and cationic surfactants", London, GB; Class P83, AN 930–389345 of JP–A–5 289 223 (1993)—Abstract.

*Primary Examiner*—Richard L. Schilling

*Attorney, Agent, or Firm*—Frishauf, Holtz, Goodman, Langer & Chick, P.C.

[57] ABSTRACT

A method of processing, by use of an automatic processor, a silver halide photographic light-sensitive material comprising a support having thereon a silver halide emulsion layer comprising the steps of developing, fixing, washing and drying the photographic material, wherein a developer has a pH of 10.4 or more and is replenished at a rate of 50 to 220 ml/m$^2$, and wherein the silver halide emulsion layer contains a spectral sensitizing dye selected from carbocyanine, dicarbocyanine and merocyanine dyes.

4 Claims, No Drawings

PROCESSING METHOD OF A SILVER HALIDE PHOTOGRAPHIC MATERIAL

FIELD OF THE INVENTION

The present invention relates to a method of processing a silver halide photographic light-sensitive material little in sensitivity variation, processing temperature dependence and deterioration of silver image tone even when developed at low replenishing rate.

BACKGROUND OF THE INVENTION

When a silver halide photographic light sensitive material is running-processed by an automatic processor, processing solutions each are deteriorated with increase of processing amounts. Deterioration of a developer is caused by the following factors; one is processing exhaustion in which a developer component reacts with a component of the photographic material to be deactivated and another one is air-oxidation exhaustion in which the pH of the developer is decreased as a result of absorption of carbon dioxide gas and developing agent is oxidized.

In the processing exhaustion move-mentioned, halide ions which are a constituent of a photographic material are dissolved-out into a developer and since iodide ions among the halide ions disssolved-out is replaced with bromide ions in silver bromide, there are, in the developer, accumulated bromide ions, which act as a developing retarder to exert a harmful effect on the developer.

In order to process stably a photographic material, it is necessary to exclude these deteriorating causes. The status of arts is such that, for the purpose of supplying an usable material and diluting an useless material concentration, a replenishing solution is supplied in a deteriorating-equivalent amount to keep photographic characteristics constant at a given level.

As a replenishing method of a processing solution, there have been so far proposed a number of techniques such as a method in which a processing solution is replenished continuously or intermittently in proportion to the processing amount to be recovered from exhaustion, as disclosed JP-A 55-126242 (the term "JP-A" means an "unexamined published Japanese patent application"), 55-126243, 57-195245, 57-195246, 57-195247, 60-104946, 62-238559 and 1-140156.

On the other hand, a photographic processing effluent has been discharged directly to the sewer, causing water-pollution in a river, lake and sea.

Recently, to decrease environmental pollution and simplifying processing work, there has been desired a decrease in a processing effluent amount; as embodiments thereof, reduction of the replenishing amount and regeneration of the processing effluent for reuse thereof are cited. Reduction of the developer replenishing amount resulted in an increase in sensitivity variation and processing temperature dependence when running-processed in an automatic processor and there occurred a problem such that photographic performance of high sensitivity could not be constantly achieved. Furthermore, there was caused a disadvantage such that silver image lost neutral black tone and was tinged with yellow-reddish color. Accordingly, it was practically impossible to reduce the replenishing amount.

Recently, as a technique for enhancement of developability, the use of tabular grains having a high aspect ratio and a small grain thickness to increase a covering power was disclosed in U.S. Pat. Nos. 4,111,986, 4,434, 226, 4,413,053. While this technique led to an improvement in developability, there was a problem such that silver image tone became yellowish. The silver image tone, which has been well-known to be related unexceptionally with grain sizes and grain thicknesses was a matter to be considered in the case of a fine grain emulsion or tabular grain emulsion.

In the prior arts, a compound for toning developed silver, so-called toning agent has been employed. However, the use of this compound, which results in a remarkable decrease in sensitivity and developability of silver halide emulsion, cannot be applied to the present invention directed to high sensitivity and rapid processability.

There has been desired development of a highly sensitive and highly processable silver halide photographic material for radiography with processing stability and without producing an yellow-reddish silver image.

SUMMARY OF THE INVENTION

Accordingly, the object of the present invention is to provide a processing method of a silver halide photographic light sensitive material whereby there can be obtained a silver image tone without being tinged With yellowish red even when developed at a replenishing rate of 50 to 220 $ml/m^2$ and stabilized-photographic characteristics improved in processing variation of sensitivity and processing temperature dependence at running-processing.

The above object of the present invention can be achieved by the invention as below.

(1) A method of processing a silver halide photographic light-sensitive material comprising a support having thereon a silver halide emulsion layer characterized in that said silver halide emulsion layer contains a spectral sensitizing dye represented by Formulas [I] or [II] as afore-mentioned; said photographic light-sensitive material is, after exposure thereof, processed with a developer having a pH of not less than 10.40 and at a developer replenishing rate of 50 to 220 $ml/m^2$.

(2) A method of processing a silver halide photographic light-sensitive material comprising a support having thereon a silver halide emulsion layer characterized in that said silver halide emulsion layer contains a spectral sensitizing dye represented by Formula [III] as afore-mentioned; said photographic light-sensitive material is, after exposure thereof, processed with a developer having a pH of not less than 10.40 and at a developer replenishing rate of 50 to 220 $ml/m^2$.

(3) A method of processing a silver halide photographic light-sensitive material comprising a support having thereon a silver halide emulsion layer characterized in that said silver halide emulsion layer contains a spectral sensitizing dye represented by Formula [IV] as afore-mentioned; said photographic light-sensitive material is, after exposure thereof, processed with a developer having a pH of not less than 10.40 and at a developer replenishing rate of 50 to 220 $ml/m^2$.

Formula [I]

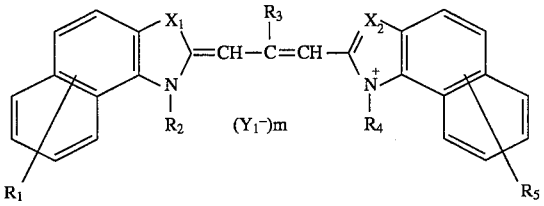

wherein $R_1$ and $R_5$, which may be the same with or different from each other, represent each a hydrogen atom, an alkyl group, an alkoxy group, a halogen atom or a carboxy group; $R_2$ and $R_4$, which may be the same with or different from each other, represent a substituted or unsubstituted alkyl group; $R_3$ represents an alkyl group; $X_1$ and $X_2$, which may be the same with or different from each other, represent a sulfur or selenium atom; $Y_1^-$ represents a counter ion; m is 0 or 1, provided that, when an intramolecular salt is formed, m is 0, Formula [II]

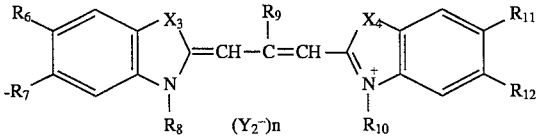

wherein $R_6$, $R_7$, $R_{11}$ and $R_{12}$, which may be the same with or different from each other, represent each a hydrogen atom, an alkyl group, an alkoxy group, a halogen atom, a hydroxy group or a carboxy group; $R_8$ or $R_{10}$, which may be the same with or different from each other, represent each a substituted or unsubstituted alkyl group or aralkyl group; $R_9$ represents an alkyl group; $X_3$ nd $X_4$, which may be the same with or different from each other, represent each a sulfur or selenium atom; $Y_2^-$ represents a counter-ion; n is 0 or 1, provided that, when an intramolecular salt is formed, n is 0, Formula [III]

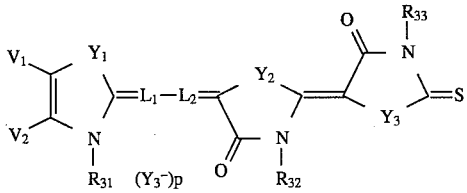

wherein $Y_1$, $Y_2$ and $Y_3$ represent independently —N(R)— group or an oxygen, sulfur or selenium atom; $R_1$ is an aliphatic group having 10 or less carbon atoms and substituted with a water-solubilizing group; $R_{32}$, $R_{33}$ and R each represent an aliphatic or aryl or heterocyclic group, provided that at least two of $R_{32}$, $R_{33}$ and R are each substituted with a water-solubilizing group; $V_1$ and $V_2$ represent each a hydrogen atom, an alkyl group, an alkoxy group, an aryl group or a heterocyclic group formed by combination of $V_1$ with $V_2$; $L_1$ and $L_2$ represent each a substituted or unsubstituted methine group; $Y_3^-$ represents a counter-ion; p represents a number necessary for neutralizing an intramolecular charge, Formula [IV]

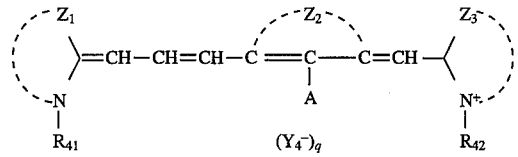

wherein $Z_1$ and $Z_3$ represent a nonmetallic atom group necessary for forming benzothiazole, benzooxazole, naphthothiazole or naphthooxazole, each of which may be substituted; $R_{41}$ and $R_{42}$ represent each a substituted or unsubstituted alkyl group; $Z_2$ represents a carbon atom group necessary for forming a 5- or 6-membered carbon ring; A represents a hydrogen atom or a substituent; q is 0 or 1, provided that, when an intramolecular salt is formed, q is 0.

DETAILED DESCRIPTION OF THE INVENTION

In a processing method of the present invention, a silver halide photographic light sensitive material of the invention is, after exposure thereof, processed with a developer having a pH of 10.40 or more, preferably 10.40 to 12.00, and more preferably 10.45 to 11.50. The developer is replenished by a developer-replenishing solution having entirely or almost the same composition as the developer and in an amount of 50 to 220 ml, preferably 80 to 200 ml, more preferably 100 to 160 ml per $m^2$ of a photographic material to be processed.

The developer-replenishing amount of the present invention is smaller than that of the prior arts, causing almost no environmental problem; and improvements in silver image tone and processing characteristics were unexpectedly achieved within a range of the replenishing amount of the invention.

A spectral sensitizing dye of the present invention will be described in further detail.

In formula[I], an alkyl group represented as $R_1$ and $R_5$ is preferably a lower alkyl group having 1 to 5 carbon atoms, which may be substituted by a hydroxyl, carboxy or sulfo group. An alkoxy group represented as $R_1$ and $R_5$ is preferably a lower alkoxy group having 1 to 5 carbon atoms. A halogen atom represented as $R_1$ and $R_5$ is chlorine, fluorine or iodine, preferably chlorine. An alkyl group represented as $R_2$ and $R_4$ is preferably a lower alkyl group having 1 to 5 carbon atoms, which may be substituted by a carboxy or sulfo group. An alkyl group represented $R_3$ is preferably a lower alkyl group having 1 to 3 carbon atoms, which may be substituted by a aryl group or halogen atom. Although a counter ion represented by $Y_1^-$, a halide ion, perchloride ion, thiocyanate, benzene-sulfonate ion, p-toluene-sulfonate ion or methylsulfonate ion ia cited, $R_1$ and $R_5$ are preferably combined with each other to form a intramolecular salt (m=0).

In formula [ii], an alkyl group, alkoxy group and halogen atom represented by $R_6$, $R_7$, $R_{11}$ and $R_{12}$ are the same ones as $R_1$ and $R_5$ of formula [I]. An alkyl group represented by $R_8$ and $R_{10}$ is the same one as $R_2$ and $R_4$ of formula [I]. As an aralkyl group represented by $R_8$ and $R_{10}$ is cited a benzyl or phenetyl group, which may be substituted by a carboxy or sulfo group. Although as a counter ion represented by $Y_2^-$ is cited the same group as $Y_1^-$ of formula [I], $R_8$ and $_{10}$ are preferably combined with each other to form an intramolecular salt (m=0).

As examples of sensitizing dyes represented by formulas [I] and [II] are cited the following, but the present invention is not limited thereto.

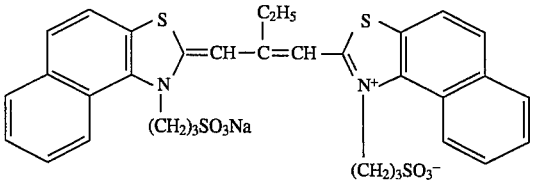
I-1
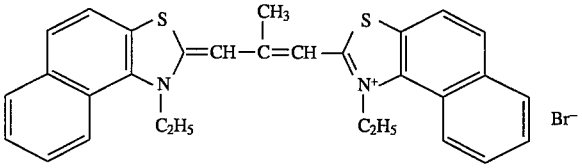
I-2
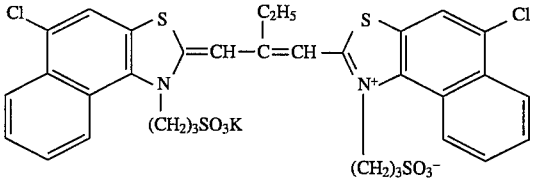
I-3
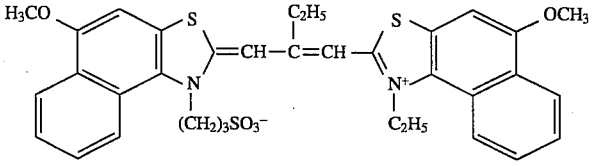
I-4
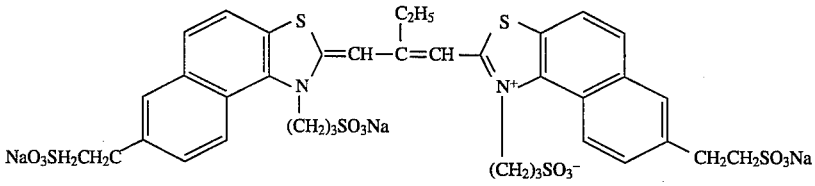
I-5
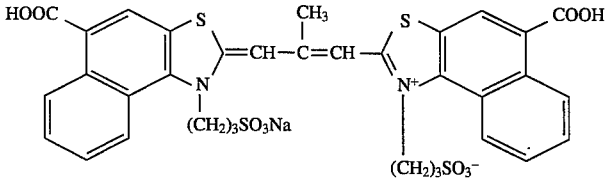
I-6
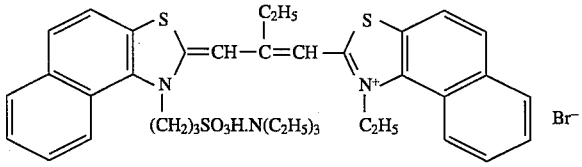
I-7
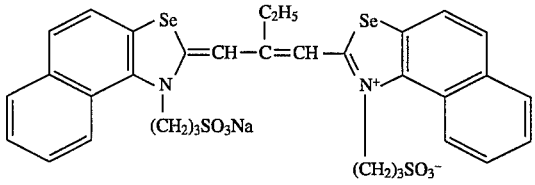
I-8
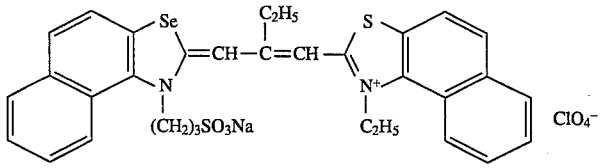
I-9

-continued
I-10
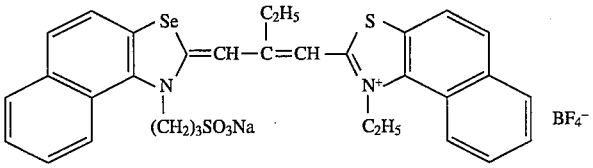
II-1
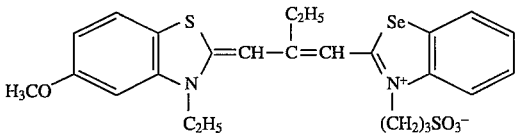
II-2
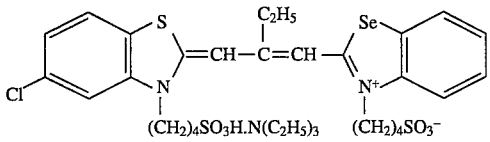
II-3
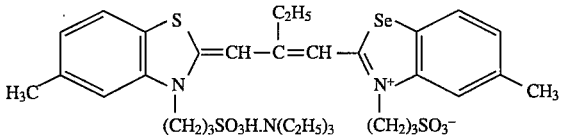
II-4
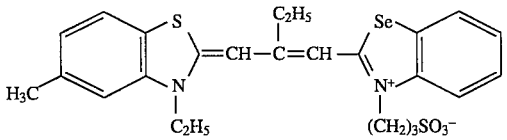
II-5
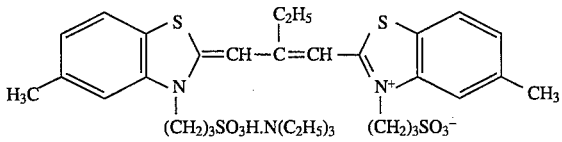
II-6
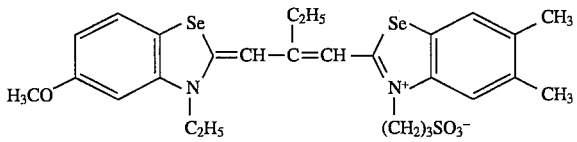
II-7
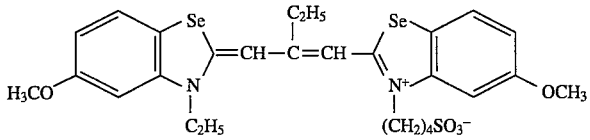
II-8
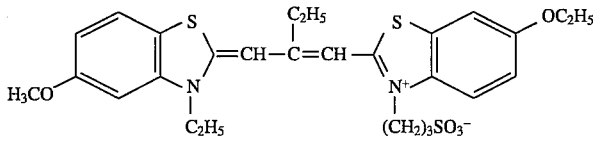
II-9
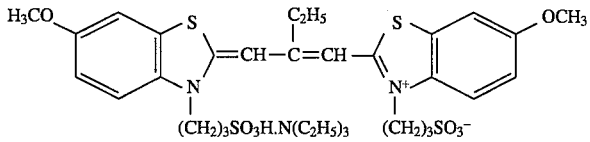
II-10
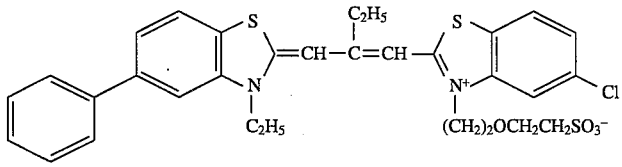

-continued
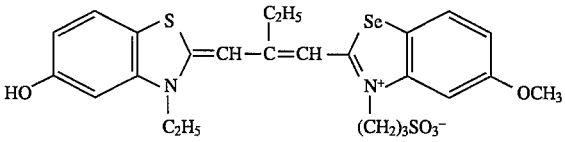
II-11
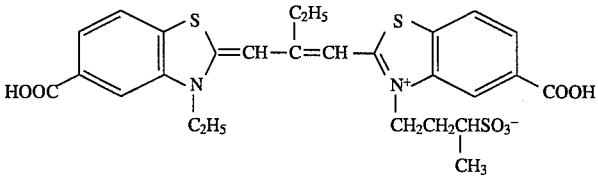
II-12
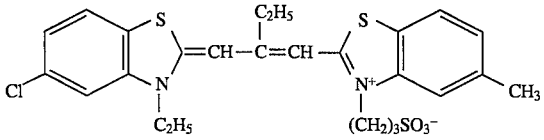
II-13
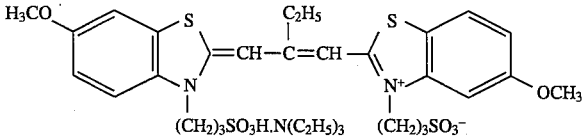
II-14
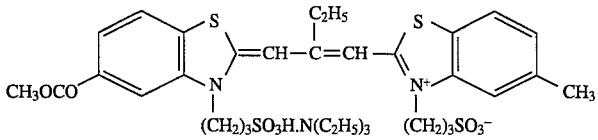
II-15
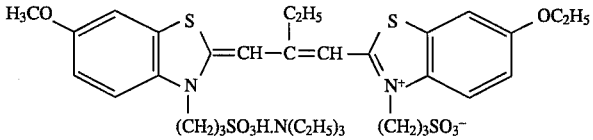
II-16
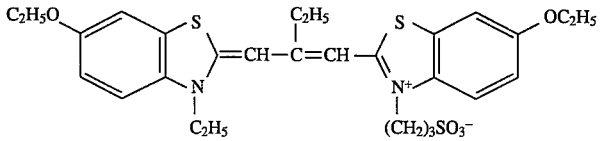
II-17
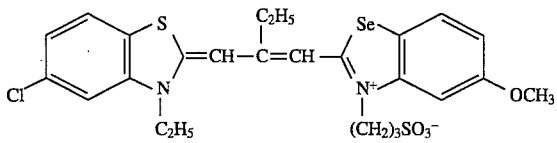
II-18
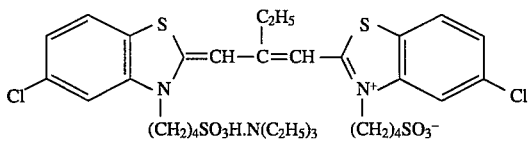
II-19
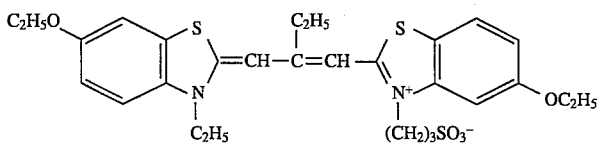
II-20
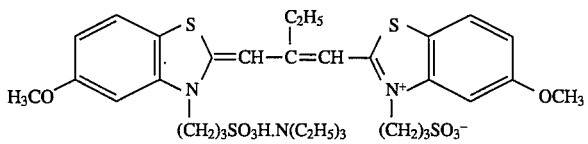
II-21

-continued

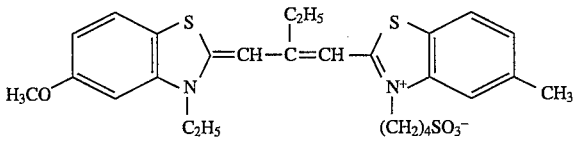

II-22

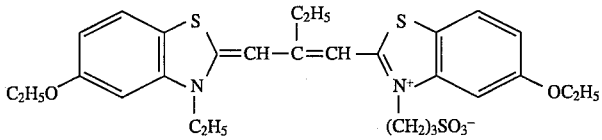

II-23

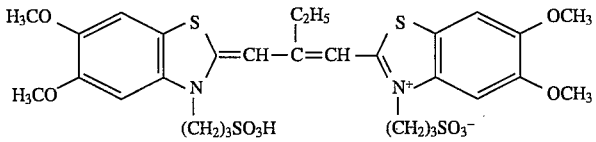

II-24

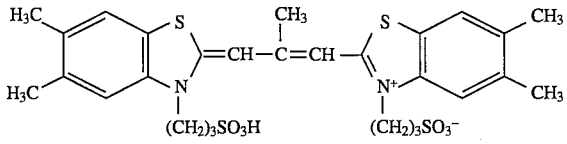

II-25

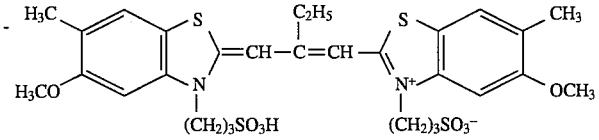

II-26

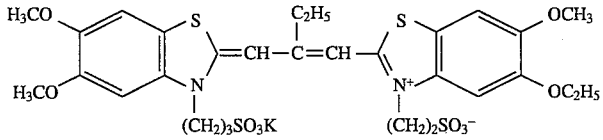

II-27

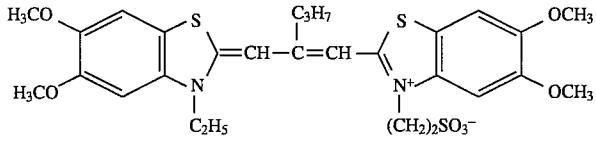

II-28

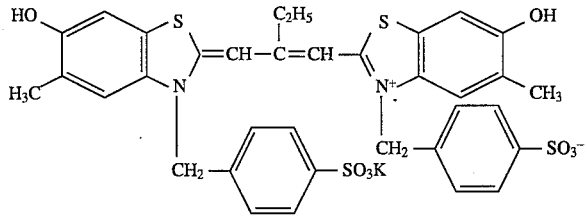

II-29

The above-described sensitizing dyes of the invention can be synthesized in the same way as in U.S. Pat. Nos. 660,408 and 3,149,105.

The amount to be used of the sensitizing dye of formulas [I] and [II], which may depends upon the kind of silver halide and the amount thereof, is 0,005 to 1.0 g, preferably 0.01 to 0.6 g per mol of silver halide, in total (I+II, I or II alone).

A sensitizing dye represented by formula [III] is described in further detail.

As examples of a water-solubilizing group represented by R, $R_1$, $R_2$ and $R_3$ of formula [III], are cited a sulfo, carboxy, phosphono, sulfate and sulfino group. As examples of an aliphatic group represented by R, $R_1$, $R_2$ and $R_3$ are cited an branched or unbranched alkyl group having 1 to 10 carbon atoms such as methyl, ethyl, n-propyl, n-pentyl or i-butyl, an alkenyl group having 3 to 10 carbon atoms such as 3-butenyl or 2-propenyl and an aralkyl group having 3 to 10 carbon atoms such as benzyl or phenetyl. As an example of an aryl group represented by R, $R_2$ and $R_3$ is cited phenyl and as a heterocyclic group is cited 2- or 4-pyridyl, 2-furyl, 2-thienyl, sulforanyl, tetrahydrofuryl or piperidyl. R, $R_1$, $R_2$ and $R_3$ may be substituted by a halogen atom (e.g., fluorine, chlorine or bromine), an alkoxy group (e.g., methoxy or ethoy), an aryloxy (e.g., phenoxy or p-tolyloxy), a cyano group, a carbamoyl group (e.g., carbamoyl, N-methylcarbamoyl or tetramethylencarbamoyl), a sulfamoyl group (e.g., sulfamoyl or N,N-3-oxapentamethyleneaminosulfonyl), a methanesulfonyl group, an alkoxycarbonyl group (e.g., ethoxycarbonyl or butoxycarbonyl), aryl (e.g., phenyl or carboxyphenyl) or an acyl group (e.g., acetyl or bezoyl).

As examples of an aliphatic group substituted by a water-solubilizing group are cited carboxymethyl, sulfoethyl, sulfopropyl, sulfobutyl, sulfopentyl, 3-sulfobutyl,6-sulfo-3-oxahexyl, ω-sulfopropoxycarbonylmethyl, ω-sulfopropylaminocarbonylmethyl, 3-sulfinobutyl, 3-sulfonopropyl, 4-sulfo-3-butenyl, 2-carboxy-2-propenyl, o-sulfobenzyl, p-sulfophenethyl and p-carboxybenzyl.

As examples of an aryl group substituted by a water-solubilizing group are cited p-sulfophenyl and p-carboxyphenyl, and as a heterocyclic group substituted by a water-solubilizing group, are cited 4-sulfothienyl and 5-carboxypyridyl. Among these groups is preferably a sulfo-substituted alkyl group as $R_1$ and at least two of R, $R_2$ and $R_3$ are preferably carboxymethyl.

As an alkyl group represented by $V_1$ and $V_2$ is cited branched or unbranched one such as methyl, ethyl, isopropyl, t-butyl, iso-buytyl, t-pentyl or hexyl. As an alkoxy group represented by $V_1$ and $V_2$ are cited methoxy, ethoxy and propoxy.

An aryl group represented by $V_1$ and $V_2$ be substituted at an appropriate position; and as examples thereof are cited phenyl, p-tolyl, p-hydroxyphenyl and p-methoxyphenyl.

As examples of a condensed ring formed by combination of $V_1$ with $V_2$ are cited benzoxazole, 4,5,6,7-tetrahydrobenzoxazole, naphtho[1,2-d]oxazole, naphtho[2,3-d]oxazole, benzothiazole, 4,5,6,7-tetrahydrobenzothiazole, naphtho[1,2-d]thiazole, naphtho[2,3-d]thiazole, benzoselenazole and naphtho[1,2-d]selenazole. Groups and condensed rings represented by $V_1$ and $V_2$ as above-mentioned may be substituted at an appropriate position by a substituent such as a halogen atom (e.g., fluorine, chlorine, bromine or iodine), trifluoromethyl, an alkoxy group (e.g., an unsubstituted alkoxy group such as methoy, ethoxy or butoxy and a substituted alkoxy group such as 2-methoxyethoxy or benzyloxy), hydroxy, cyano, an aryloxy group (e.g., a substituted or unsubstituted phenoxy, or tolyloxy group), an aryl group (e.g., phenyl or p-chlorophenyl), a styryl group, a heterocyclic group (e.g., furyl or thienyl), a carbamoyl group (e.g., carbamoyl or N-ethylcarbamoyl), sulfamoyl (e.g., sulfamoyl or N,N-dimethylsulfamoyl), an acylamino group (e.g., acetylamino, propionylamino or benzoylamino), an acyl group (e.g., acetyl or benzoyl), alkoxycarbonyl (e.g., ethoxycarbonyl), a sulfonamide (e.g., methansulfonylamide or benzenesulfonamide), a sulfonyl group (e.g., methanesulfonyl or p-toluensulfonyl) or a carboxy group.

As a substituent represented by $L_1$ and $L_2$ are exemplified an lower alkyl group (e.g., methyl or ethyl), phenyl group (e.g., phenyl or carboxyphenyl), or alkoxy group (e.g., methoxy or ethoxy).

$Y_3^-$ represents a cation or acid anion. As examples of the cation are cited proton, a organic cation (e.g., triethylammonium or triethanolammonium) and inorganic cation (e.g., lithium, sodium and calcium ions); as examples of the acid anion are cited halide (e.g., chloride, bromide and iodide ions), p-toluenesulfonate, perchlorate and tetrafluoroborate ions.

In the case when a intramolecular salt is formed to neutralize charge, p is 0.

Examples of a sensitizing dye represented by formula [III] are described below, but the invention is not limited these compounds. In addition thereto, as a sensitizing dye of formula [III], can be employed compounds S-18 through S-35 as disclosed in JP-A 6-313942.

III-1

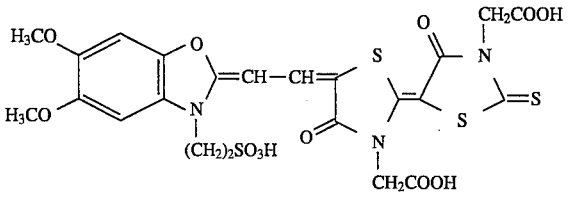

III-2

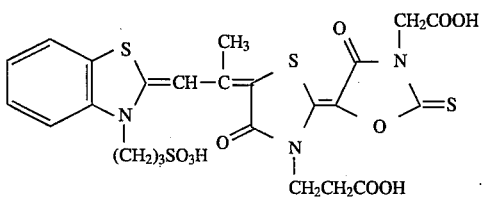

$N(C_2H_5)_3$

III-3

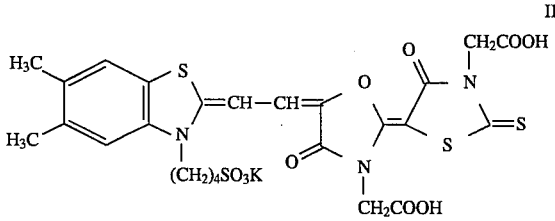

III-4

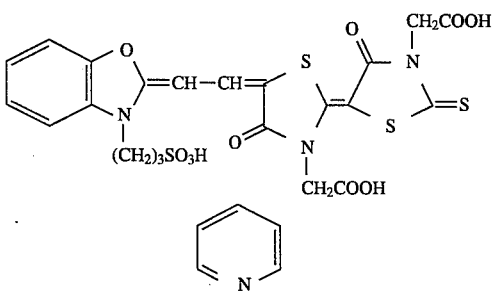

III-5

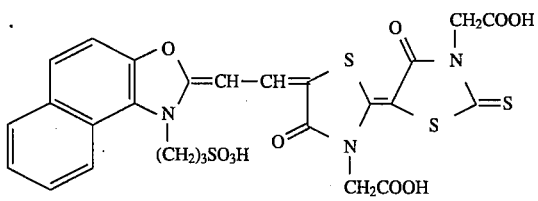

$N(C_2H_5)_3$

-continued
III-6
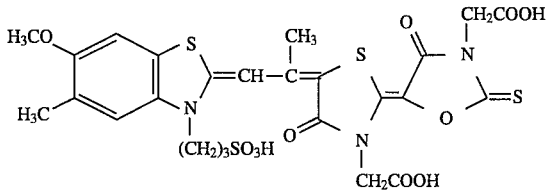
$N(C_2H_5)_3$
III-7
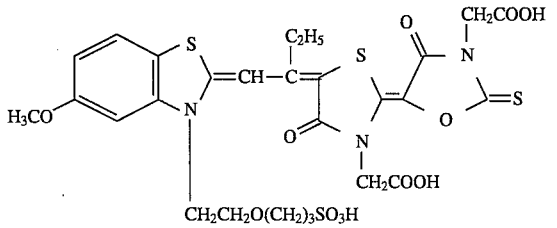
$N(C_2H_5)_3$
III-8
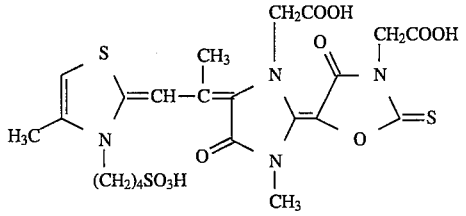
III-9
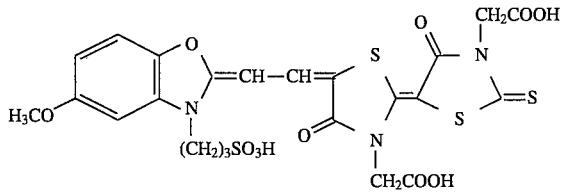
$N(C_2H_5)_3$
III-10
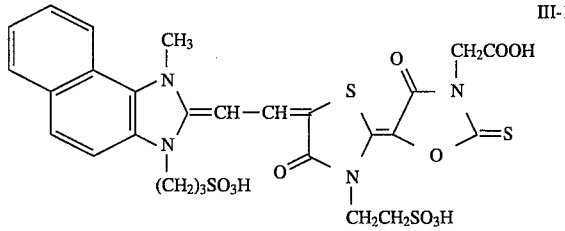
$[N(C_2H_5)_3]_2$
III-11
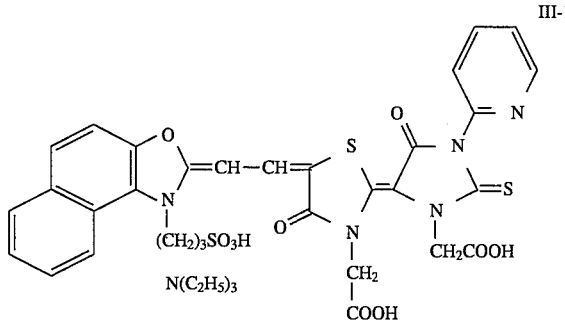
$N(C_2H_5)_3$
-continued
III-12
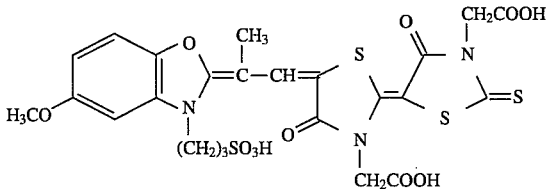
$N(C_2H_5)_3$
III-13
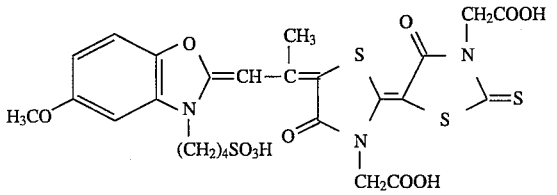
$N(C_2H_5)_3$
III-14
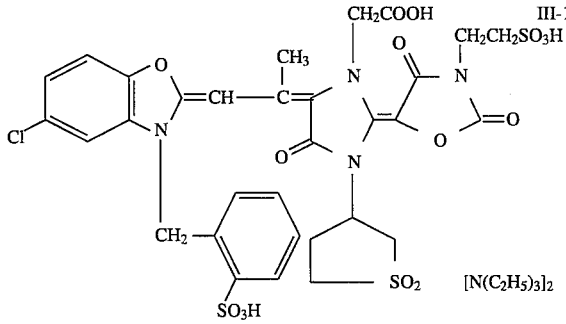
$[N(C_2H_5)_3]_2$
III-15
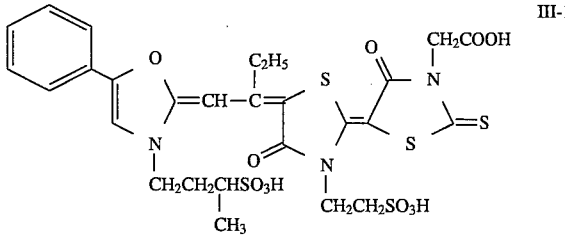
III-16
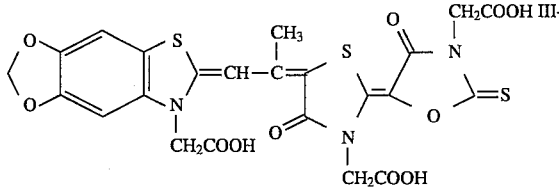
III-17
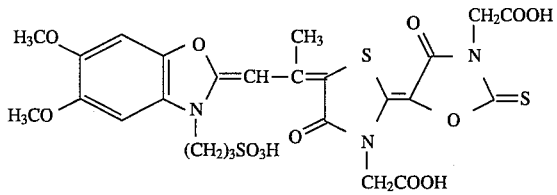
$N(C_2H_5)_3$
The above-mentioned sensitizing dye of formula [III] can be readily synthesized in such a manner as described in F. M. Hamer, The Cyanine Dyes and Related Compounds (Interscience, New York, 1964), U.S. Pat. Nos. 2,454,629 and 2,493,748.

The addition amount of the dye, which depends on the using condition and the kind of emulsion to be used, is preferably 0.005 to 1.0 g, more preferably 0.01 to 0.6 g per mol of silver halide.

A sensitizing dye represented by formula [IV] is described in further detail. In formula [IV], $Z_2$ represents an atomic group necessary for forming a five- or six-membered carbon ring and when a six-membered ring is formed, A is a hydrogen atom.

In the case when a five-membered ring is formed, formula [IV] is represented by the following formula [IV-a].

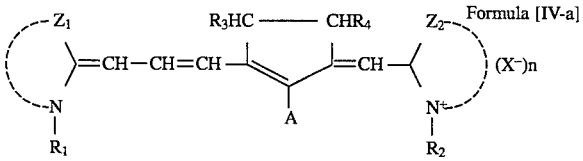

wherein A represents $-N(R_5)R_6$ or

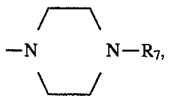

an alkyl group, a halogen atom or an alkoxy group having 1 to 4 carbon atoms; $R_5$ and $R_6$ each represent an alkyl group having 1 to 12 carbon atoms, an alkoxycarbonylalkyl group, or an aryl group which may be substituted: $R_7$ represents an alkyl group having 1 to 12 carbon atomsan aryl group having 6 to 10 carbon atoms, or an alkoxycarbonyl group, in which an alkoxy substituent have 1 to 4 carbon atoms.

In the case when a six-membered ring is formed, formula [IV] is represented by the following formula [IV-b].

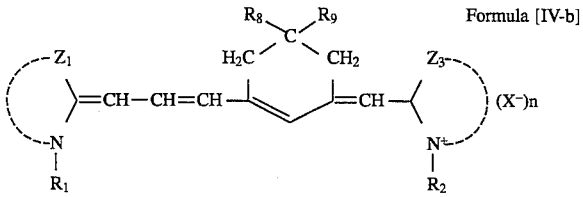

wherein $R_8$ represents a hydrogen atom or methyl; and $R_9$ represents a hydrogen atom, an alkyl group having 1 to 4 carbon atoms or a monocyclic aryl group. $X^-$ is an anion and n is 0 or 1, provided that when an intramolecular salt is formed, n is 0.

In formulas [IV-a] and [IV-b], $Z_1$ and $Z_3$ each represent a nonmetallic atom group necessary for forming a benzothiazole, benzoxazole, naphthothiazole or naphthooxazole ring, each of which may be substituted by a substituent such as a halogen atom, an alkyl group having 1 to 4 carbon atoms or an alkoxy group having 1 to 4 carbon atoms.

$R_1$ and $R_2$ each represent a saturated or unsaturated aliphatic group (e.g., methyl, ethyl, 2-hydroxyethyl, 2-methoxyethyl, 2-acetoxyethyl, carboxymethyl, 2-carboxyethyl, 3-carboxypropyl, 4-carboxybutyl, 2-sulfoethyl, 3-sulfopropyl, 3-sulfobutyl, 4-sulfobutyl, vinylmethyl, benzyl, phenethyl, p-sulfophenethyl, propyl, isopropyl or n-butyl).

In formula [IV-a], $R_3$ and $R_4$ each represents a hydrogen atom, an alkyl group having 1 to 4 carbon atoms, a halogen atom, or an alkoxy group having 1 to 4 carbon atoms; $R_5$ and $R_6$ each represent an alkyl group having 1 to 12 carbon atoms, an alkoxycarbonylalkyl group (e.g.,methoxycarbonylmethyl or ethoxycarbonylethyl), an aryl group, which may be substituted (e.g., phenyl, m-tolyl, p-tolyl, m-chlorophenyl, p-chloropheny, or m- or p-alkoxyphenyl with an alkoxy group having 1 to 4 carbon atoms); and $R_7$ represents an alkyl group having 1 to 12 carbon atoms, an aryl group having 6 to 10 carbon atoms or an alkoxycarbonyl group with an alkoxy group having 1 to 4 carbon atoms.

In formula [IV-b], $R_8$ represents a hydrogen atom or methyl; and $R_9$ represents a hydrogen atom, an alkyl group having 1 to 4 carbon atoms or a monocyclic aryl group.

$X^-$ represents an anion (e.g., chloride ion, bromide ion, iodide ion, or perchlorate, benzenesulfonate, p-toluenesulfonate, methylsulfate, ethylsulfate and tetrafluorobarate ions).

Examples of the dye represented by formula [IV] are described as below. In addition thereto, dyes [III-5] to [III-8], [III-13] to [III-16], [III-21] to [III36] as described in JP-A 4-9041 and [III-1] to [III-12] as described in JP-A 5-281646, both of which was filed by the same applicant as in the present invention can be employed.

Examples of formula [IV]

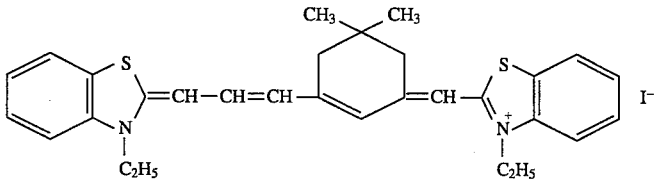

IV-1

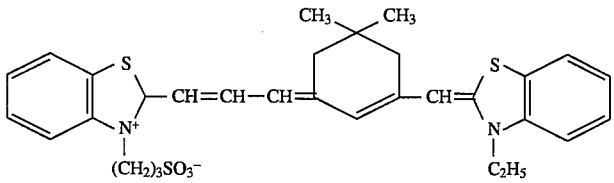

IV-2

-continued

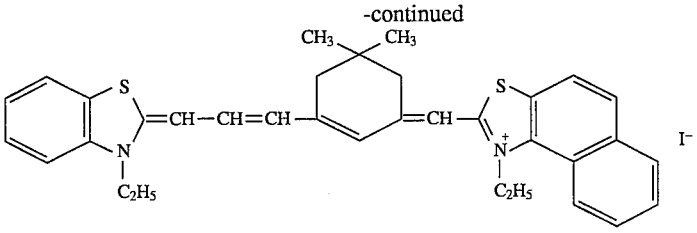

IV-3

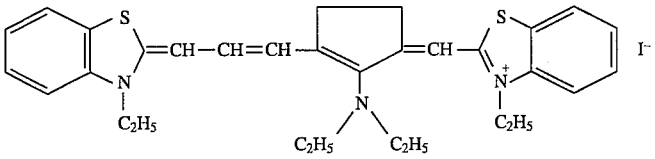

IV-4

The dyes represented by formula [IV] can be synthesized in accordance with a method as described in U.S. Pat. Nos 2,734,900 and 3,482,978.

The addition amount of the dye represented by formula [IV], which depends on the working condition and the kind of silver halide, is preferably 0,005 to 1.0 g, more preferably 0.01 to 0.6 g per mol of silver halide.

The dye may be added optimally at the time during the course of emulsion making from physical ripening to emulsion-coating, preferably from physical ripening to the completion of chemical ripening.

In the case when added during the physical ripening or chemical ripening process, the dye of the invention is added preferably prior to or immediately after the addition a chemical sensitizer.

The dye of the invention can be dissolved in accordance with a well known method. For example, there can be optimally selected from a protonating dissolution method as disclosed in JP-A 50-80826 and 50-80827, a dispersing addition method with a surfactant as disclosed in U.S. Pat. No. 3,822,135 and JP-A 50-11419, a method of dispersing in a hydrophilic substrate as disclosed in U.S. Pat. Nos. 3,676, 147, 3,469,987 and 4,247,627, JP-A 51-59942, 53-16624, 53-102732, 53-102733 and 53-137131, a method of adding as a solid solution disclosed in East German Patent No. 143,324 an a method of dissolving in a water-soluble solvent (e.g., low-boiling solvents such as water, methanol,, ethanol, propyl alcohol, acetone and a fluorinated alcohol; high-boiling solvents such as dimethylforamide, methyl cellosolve and phenyl cellusolve) singly or in combination thereof.

The dye of the invention can be used in combination with other spectral sensitizing dye(s), wherein the dyes may be added together or separately.

The use of the dye applicable in the invention in combination with a supper-sensitizing compound can achieve further an enhancement in spectral sensitivity. As examples of the supper-sensitizing compound are cited a compound having a pyrimidinylamino or triadinylamino group as disclosed in U.S. Pat. Nos. 2,933,390, 3,416,927, 3,51,664, 3,615,613, 3,615,632, 3,635,721, and JP-A 3-15042, 3-110545 and 4-255841; an aromatic formaldehyde condensation compound as disclosed in British Pat. No. 1,137,580 and JP-A 61-169833; a calix-arene derivative as disclosed in JP-A 4-184332; a halogenated benzotriazole derivative as disclosed in U.S. Pat. No. 4,030,927; a bispyridinium compound as disclosed in JP-A 59-142541 and 59-18861; an aromatic heterocyclic tertiary salt as disclosed in JP-A 59-191032; an electron-donating compound as disclosed in JP-A 60-79348; a polymeric compound containing an aminoarylidenemalononitrile unit as disclosed in U.S. Pat. No. 4,307,183; a hydroxytetrazaindene derivative as disclosed in JP-A 4-149937; a 1,3-oxadiazole derivative as disclosed in U.S. Pat. No. 3,615,633; an amino- 1,2,3,4-thiatriazole derivative as disclosed in U.S. Pat. No. 4,780,404.

Silver halide grains applicable in the present invention are described in further detail.

The photographic light sensitive material comprises a support having on one side thereof a light sensitive silver halide emulsion, in which the total coating weight of silver is 3.5 g or less, preferably, 2.0 to 3.3 g per $m^2$ of one side of the photographic material.

A chemically sensitized silver halide emulsion used in the invention comprises silver bromide, silver iodobromide, silver chlorobromide and silver iodochlorobromide; preferably, silver brimide, silver iodobromide or silver iodochlorobromide.

As a crystal form, silver halide grains of the invention may be regular crystal grains having a cubic, octahedral or octadecahedral form, or single- or multi-twinned crystal grains having various forms.

A silver halide emulsion used in the invention can be prepared in a manner as well-known in the art. Emulsion preparation methods applicable in the invention are referred, for example, to Research Disclosure (RD) No. 17643, pages 22–23 (Dec., 1978), "Emulsion Preparation and Types"; RD No. 18716, 648 (Nov., 1979); T. H. James, "The Theory of the Photographic Process " 4th Ed. 38–104 (Macmillan, 1977); G. F. Duffin, "Photographic Emulsion Chemistry" (Focal Press, 1966); P. Glafkides, "Chemie et Physique Photographoque" (Paul Montel, 1967); V. L. Zelikman et al., "Making and Coating Photographic Emulsion" (Focal Press, 1964).

The emulsion can be prepared by combining various conditions; i.e., solution conditions such as acidic precipitation, ammoniacal precipitation and neutral precipitation, mixing conditions such as a normal precitation, reverse precitation, double-jet precitation and controlled double-jet precitation, a conversion method and a core/shell method.

The silver halide emulsion grains of the invention have an average grain size of 0.1 to 2.0 μm, preferably, 0.1 to 0.6 μm, and may be monodispersed or polydispersed. A monodispersed emulsion of the invention is a silver halide emulsion having a variation coefficient of 0.20 or less regading a grain size distribution as defined in JP-A 60-162244.

The monodispersed emulsion of the invention is comprised of silver halide grains having an average grain size of 0.1 μm or more, in which at least 95% by weigh of total grains have grain sizes within ±40% of the average grain size. Further, the monodispersed emulsion is comprised of grains having an average grain size of 0.25 to 2 μm, in which at least 95% of total grains by number or weight have grain sizes within ±20% of the average grain size. The term "average grain size" is defined to a diameter when grains are spherical-formed, or to be a diameter equivalent to the projected area of the grain when the grains are cubic or a form other than spherical one.

A preparation method of the above-mentioned monodispersed emulsion is well-known in the art, as disclosed in J. Phot. Sci. Vol. 12, 242–251 (1963); JP-A 48-36890, 52-16364, 55-142329, 58-49938, British Pat. No. 1,413,748, U.S. Pat. Nos. 3,574,628 and 3,655,394. The emulsion can be also prepared by the use of seed crystals, which are further grown by supplying silver and halide ions to form silver halide grains.

Silver halide emulsion grains of the invention may have a layered-structure comprising different halide compositions between an inside portion and an outside portion within the grain. As a preferable embodiment of the invention, the grains have two distinctive layer structure comprising a core containing high iodide and a shell containing low iodide within the grain (core/shell structure).

The high iodide-containing core contains silver iodide of 20 to 40 mol %, preferably 20 to 30 mol %.

The core further contains silver bromide or silver chlorobromide, in which a high bromide content is preferable.

The outermost shell comprises silver halide containing silver iodide of 5 mol % or less, preferably 2 mol % or less. The shell further contains silver chloride, silver bromide or silver chlorobromide, in which a high bromide content is preferable.

The preparation of the above-mentioned core/shell type emulsion has been well known in the art, as referred to J. Phot. Sci., Vol. 24, 198 (1976), U.S. Pat. Nos. 2,592,250, 3,505,068, 4,210,450, 4,444,877 and JP-A 60-3331.

The silver emulsion may be subjected to noodle washing or flocculation washing to remove water soluble salts. As a preferred embodiments thereof, are cited desalting methods with the use of a sulfo group-containing aromatic hydrocarbon/aldehyde resin as disclosed in Japanese Pat. examined No. 35-16086 and with the use of polymeric flocculants G-3 or G-8 as described in JP-A 63-58644.

To a silver halide emulsion used in the photographic material of the invention are added various kinds of photographic additives at a time before, during or after physical ripening or chemical ripening.

As the additives, can be employed compounds as described in afore-mentioned RD Nos. 17643, 18716 and 308119, wherein relevant types of compounds and sections thereof are follows.

| | RD-17643 | | RD-18716 | RD-308119 | |
|---|---|---|---|---|---|
| Additive | Page | Sec. | Page | Page | Sec. |
| Chemical sensitizer | 23 | III | 648 upper right | 996 | III |
| Sensitizing dye | 23 | IV | 648–649 | 996–8 | IVA |
| Desensitizing dye | 23 | V | | 998 | IVB |
| Dye | 25–26 | VII | 649–650 | 1003 | VIII |
| Developing accelerator | 24 | XXI | 648 upper right | | |
| Antifoggant/ stabilizer | 24 | IV | 649 upper right | 1006–7 | VI |
| Brightening agent | 24 | V | | 998 | V |
| Hardening agent | 26 | X | 651 left | 1004–5 | X |
| Surfactant | 26–27 | XI | 650 right | 1005–6 | XI |
| Plastcizer | 27 | XII | 650 right | 1006 | XII |
| Sliding agent | 27 | XII | | | |
| Matting agent | 28 | XVI | 650 right | 1008–9 | XVI |
| Binder | 26 | XVII | | 1003–4 | IX |
| Support | 28 | XVII | | 1009 | XVII |

As a support used in the photographic material of the invention, is cited one described in the above-described Research Disclosures. A preferred support is a plastic film. For the purpose of improving adhesion of a coating layer, the surface of the support may be provided with a subbing layer or subjected to corona discharge or U.V.-ray irradiation.

The photographic material comprises hydrophilic colloid layers such as a silver halide emulsion layer, a protective layer, an interlayer, a filter layer, U.V.-absorbing layer, an antistatic layer, an antihalation layer and a backing layer As a binder or protective colloid of the hydrophilic layer, gelatin or synthetic polymer compounds can used.

There may be used lime-processed gelatin, acid-processed gelatin or other gelatin derivatives. Besides gelatin, as synthetic polymer compounds, are cited a cellulose derivative such as hydroxyethyl cellulose, or polyvinyl alcohol, a partial-acetal of polyvinyl alcohol, poly-N-vinylpyrroridone, polyacrylate, polyacrylamide, or copolymer thereof.

In a processing method of a photographic material of the invention with the use of an automatic processor comprising developing, fixing, washing and drying steps, a total process from the development to the drying is preferable to be completed within 45 seconds.

Thus, a total time from the time when a top of the photographic material is dipped into a developer to the time when the top comes out from a drying zone (so-called, Dry to dry time) is 45 seconds or less, preferably 25 to 45 seconds.

A developer contains, as a developing agent, 1,4-dihydroxybenzenes, and, if necessary, p-aminophenol type compounds and/or pyrrazolidone type compounds.

An addition amount of 1,4-dihydroxybenzenes is 0.01 to 0.7 mol, preferably, 0.1 to 0.5 mol per liter of a developer.

An addition Amount of the aminophenol compound or the pyrrazolidone compound is 0.0005 to 0.2 mol, preferably, 0.001 to 0.1 mol per liter of a developer.

The developer may contain a sulfite such as sodium sulfite, potassium sulfite, lithium sulfite, ammonium sulfite, sodium bisulfite or potassium metasulfite. An amount of the sulfite to be used is 0.1 to 2.0 mol, preferably, 0.1 to 1.0 mol per liter of a developer. In the case of a concentrated developer, the upper limit of the amount is preferably 3.0 mol per liter of the developer.

The developer may contain a chelating agent having a chelate stability constant for an iron ion of 8 or more.

As examples of chelating agents having a stability constant for an iron ion of 8 or more, are cited an organic carboxylic acid chelating agent, an organic phophoric acid chelating agent, an inorganic phophoric acid chelating agent and a polyhydroxy-compound The developer may contain a hardener capable of curing gelatin contained in the photographic material to strengthen physical properties of a layer. As a hardener, can be used, for example, glutaraldehyde, α-methylglutaraldehyde, β-methylglutaraldehyde, malediadehyde, succindialdehyde, methoxysuccindialdehyde, mehtylsuccindialdehyde, α-methoxy-βethoxyglutaraldehyde, α-n-butoxyglutaraldehyde, α,α-dimethoxysuccindialdehyde, β-isopropylsuccindialdehyde, α,α-diethylsuccindialdehyde or butylmalediadehyde including a bisulfite addition compound thereof.

The pH of a developer is 10.40 to 12.00, preferably, 10.45 to 11.50. An alkaline agent or buffering agent to be used for adjusting the pH includes sodium hydroxide, potassium hydroxide, sodium carbonate, potassium carbonate, boric acid, trisodium phosphate and tripotassium phosphate.

A fixer contains a fixing agent such as sodium thiosulfate or ammonium thiosulfate. Among them, ammonium thiosulfate is preferable from the fixing speed. The amount to be used is 0.1 to 6 mol per liter.

The fixer may contain water soluble aluminium salt, as a hardener, such as aluminium chloride, aluminium sulfate or potassium alum.

The fixer may contain maleic acid, tartaric acid, citric acid, gluconic acid or derivative thereof singly or in combination thereof. The compound is contained in an amount of 0.001 mol or more, preferably, 0,005 to 0.03 mol per liter of a fixer.

The pH of the fixer is 3.8 or more, preferably, 4.2 to 7.0. Considering fixer-hardening and silfite-smell, the pH of 4.3 to 4.8 is preferable.

EXAMPLES

The present invention is explained in the following examples, but embodiments of the invention are not limited thereto.

Example 1

Silver iodobromide seed emulsion grains having an average grain size of 0.1 μm and an average iodide content of 2 mol % were further grown by supplying an aqueous ammoniacal silver nitrate solution and an aqueous potassium bromide solution by a double jet method to prepare a monodispersed, cubis crystal silver iodobromide emulsion having an average grain size of 0.25 μm and an average iodide content of 0.1 mol %. The resulting emulsion was proved to have a variation coefficient ((σ/r) of 0.17 with respect to grain size distribution.

After the emulsion was dissolved immediately prior to chemical ripening and adjusted to be at a given temperature, sensitizing dyes as set forth in Table 1 was added to the emulsion and subjected to chemical ripening by adding thereto ammonium thiocyanate, chloroauric acid and sodium thisulfate; and after completing chemical ripening, 4-hydroxy-1,3,3a,7-tetrazaindene was added.

To the resulting emulsion, the following additives were added in amounts per mol of silver halide to prepare an emulsion coating solution.

| | |
|---|---|
| Nitrophenyl-triphenylphosphonium chloride | 30 mg |
| Ammonium 1,3-dihydroxybenzene-4-sulfonate | 1 g |
| Sodium 2-mercaptobenzimidazole-5-sulfonate | 10 mg |
| 2-Mercaptobenzothiazole | 10 mg |
| Trimethylol propane | 9 g |
| 1,1-Dimethylol-1-bromo-1-nitromethane | 10 mg |
| $C_4H_9OCH_2CH(OH)CH_2N(CH_2COOH)_2$ | 1 g |

-continued

| | |
|---|---|
| 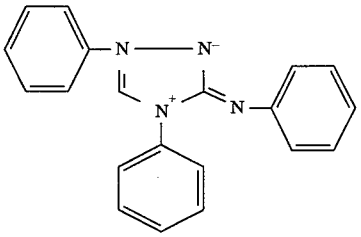 | 60 mg |
| 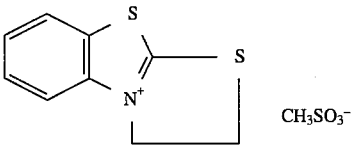 | 35 mg |

Protective layer coating solution (emulsion-side)

| Composition is as follows, wherein the addition amount is expressed in an amount per liter of the solution. | |
|---|---|
| Lime-processed inert gelatin | 68 g |
| Acid-processed gelatin | 2 g |
| Sodium i-amyl-n-decyl-sulfosuccinate | 1 g |
| Polymethylmethaacrylate particles (4 μm)/ silicon dioxide particles (1.2 μm), matting agent | 0.5 g |
| Rudox AM (colloidal silica produced by du'Pont) | 30 g |
| Aqueous solution (2%) of sodium 2,4-dichloro-hydroxy-1,3,5-triazine (hardener) | 10 cc |
| 35% Formalin aqueous solution (hardener) | 1.5 cc |

Backing layers were provided on the other side of the support. Thus, a dye dispersion comprised of 400 g of gelatin, 2 g of polymethylmethaacrylate particles having an average diameter of 6 μm, 24 g of potassium nitrate, 6 g of sodium dodecylbenzenesulfonate, 20 g of antihalation dye-1 as shown below and glyoxal was coated in an amount of 2 g/m$^2$ on a subbing layer provided on a polyethylen-terephthalate base which was comprised of glycidylmethacrylate-methylmethacrylate-butylmethacrylate copolymer (weight ratio, 50:10:40), and further thereon was coated a protective layer solution comprised of gelatin, a matting agent, glyoxal and sodium dodecylbenzenesulfonate.

Coating amounts of the backing layer and protective layer were each 2 g/m$^2$.

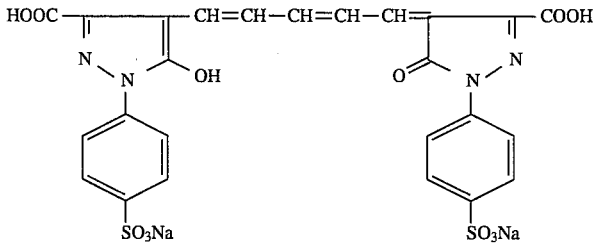

Antihalation dye-1

Photographic material samples were prepared by coating the above-described emulsion coating solution and protective layer coating solution on the backing layer-coated support by means of a slide-hopper. The coating amount of silver was 3.0 g/m$^2$; the coating amounts of gelatin for emulsion and protective layers were each 3 g/m$^2$ and 1.2 g/m$^2$.

Compositions of a developer and a fixer used were as follows.

| | |
|---|---|
| Developer | |
| Part-A: | |
| Potassium hydroxide | 450 g |
| Potassium sulfite (50% aq. solution) | 2280 g |
| Diethylenetetraminepentaacetic acid | 120 g |
| Sodium hydrogencarbonate | 132 g |
| 5-Methylbenzotriazole | 1.2 g |
| 1-Phenyl-5-mercaptotetrazole | 0.2 g |
| Hydroquinone | 340 g |
| Water to make | 5 l |
| Part-B: | |
| Acetic acid anhydride | 170 g |
| Triethyleneglycol | 185 g |
| 1-Phenyl-3-pyrrazolidone | 22 g |
| 5-Nitroindazole | 0.4 g |
| Starter solution: | |
| Acetic acid anhydride | 120 g |
| Potassium bromide | 225 g |
| Water to make | 1 l |
| Fixer | |
| Part-A: | |
| Ammonium thiosulfate (70 wt/vol %) | 6000 g |
| Sodium sulfite | 110 g |
| Sodium acetate trihydride | 450 g |
| Sodium citrate | 50 g |
| Gluconic acid | 70 g |
| 1-(N,N-dimethylamino)-ethyl-5-mercaptotetrazole | 18 g |
| Part-B | |
| Aluminium sulfate | 800 g |

The developer was prepared by dissolving Part-A and B into 5 l of water while being stirred and further adding water to make-up 12 l. The pH thereof was adjusted to 10.4 (DEV 1) or 10.70 (DEV 2). The developer was also used as a replenisher. A working developer was prepared by adding 20 cc of a starter to 1 l of the developer prepared as above and adjusting a pH to 10.15 or 10.45.

A fixer was prepared by adding to 5 l of water Part-A and B, further adding water to make 18 l, while being stirred and adjusting the pH to 4.4 with sulfuric acid or sodium hydroxide. Thus prepared fixer was used as a replenisher. Evaluation of silver image tone:

A photographic material sample was exposed to tungsten-light so as to produce 1.0 of transmission density and then subjected to processing in 45 second-mode with an automatic processor for radiography SRX-502 (product of Konica Corp.) using the developer and fixer as above-described. Processing temperatures were 35° C. in developing, 33° C. in fixing, 20° C and 45° C. in drying, respectively. The developer was replenished in amounts as shown in Table 1, and the fixer was replenished in an amount of 400 ml/m$^2$. After 500 pieces of samples having 10×12 inch size were processed, a processed sample was visually observed on a viewing box and evaluated with respect to silver image color, based on the following grades.

A: Black

B: Slightly reddish black

C: Slightly yellow-reddish black

D: Heavily yellow-reddish black

Results thereof are shown in Table 1.

Sensitometry:

Samples were exposed to tungsten light so as to produce a transmission density of 1.0 and the precessing thereof was run until the processing level reached a steady state (2000 pieces of samples having 10×12 inch size were processed). Sensitometrical examination was made at an initial level and another level after running to evaluate process stabilities. Processing was conducted in the same manner as in Example 1, provided that a developer was replenished in amounts as shown in Table 1 and an replenishing amount of a fixer was 400 ml/m$^2$.

A 14×17 cm-sized sample exposed to semiconductor laser light (670 nm) through a wedge was sensotometrically evaluated. Sensitivity was shown as a relative value based on the sensitivity of a sample processed at the initial stage of running-processing being 100. With respect to processing stability, a sensitivity at the stage after running-processed was compared with a sensitivity at the initial stage of running-processing.

Processing temperature dependence:

Processing temperature variation is represented in terms of a difference in gradation ($\Delta\gamma$) or maximum density ($\Delta D_{max}$) when developed at 32° and 35° C. The less is the value, the smaller is the variation and an improvement in the process stability is achieved. "$\gamma$" is defined to be tan $\theta$ (slope) of a straight line that connects two points corresponding to densities of 0.25 above fog density and 2.0 above fog density on a characteristic curve. Results thereof are summarized in Table 1.

TABLE 1

| Sample No. | Sensitizing dye Compd. No. | Sensitizing dye Amount (mg/Ag mol) | Sensitizing dye Compd. No. | Sensitizing dye Amount (mg/Ag mol) | Developer pH | Developer Replenisher (ml/m$^2$) | Silver image tone | Sensitivity Initial | Sensitivity After running-processing | Processing stability $\Delta\gamma$ | Processing stability $\Delta Dm$ | Remarks |
|---|---|---|---|---|---|---|---|---|---|---|---|---|
| 1 | I-1 | 45 | | | 10.15 | 300 | B | 100 | 95 | 0.21 | 0.23 | Comp. |
| 2 | I-1 | 45 | | | 10.15 | 150 | D | 100 | 83 | 0.17 | 0.19 | Comp. |
| 3 | I-I | 45 | | | 10 45 | 300 | A | 100 | 105 | 0.15 | 0.12 | Comp. |
| 4 | I-1 | 45 | | | 10.45 | 150 | A | 100 | 98 | 0.09 | 0.05 | Inv. |
| 5 | I-3 | 45 | | | 10.15 | 300 | B | 100 | 95 | 0.19 | 0.2 | Comp. |
| 6 | I-3 | 45 | | | 10.15 | 150 | D | 100 | 82 | 0.15 | 0.18 | Comp. |
| 7 | I-3 | 45 | | | 10.45 | 300 | A | 100 | 96 | 0.15 | 0.11 | Comp. |
| 8 | I-3 | 45 | | | 10.45 | 150 | A | 100 | 98 | 0.1 | 0.05 | Inv. |
| 9 | | | II-19 | 45 | 10.15 | 300 | B | 100 | 96 | 0.2 | 0.21 | Comp. |
| 10 | | | II-19 | 45 | 10.15 | 150 | D | 100 | 83 | 0.15 | 0.17 | Comp. |
| 11 | | | II-19 | 45 | 10.45 | 300 | A | 100 | 105 | 0.15 | 0.12 | Comp. |
| 12 | | | II-19 | 45 | 10.45 | 150 | A | 100 | 99 | 0.08 | 0.04 | Inv. |
| 13 | | | II-23 | 45 | 10.15 | 300 | B | 100 | 96 | 0.21 | 0.23 | Comp. |

TABLE 1-continued

| Sample No. | Sensitizing dye Compd. No. | Sensitizing dye Amount (mg/Ag mol) | Sensitizing dye Compd. No. | Sensitizing dye Amount (mg/Ag mol) | Developer pH | Developer Replenisher (ml/m²) | Silver image tone | Sensitivity Initial | Sensitivity After running-processing | Processing stability Δγ | Processing stability ΔDm | Remarks |
|---|---|---|---|---|---|---|---|---|---|---|---|---|
| 14 | | | II-23 | 45 | 10.15 | 150 | D | 100 | 81 | 0.17 | 0.18 | Comp. |
| 15 | | | II-23 | 45 | 10.45 | 300 | A | 100 | 105 | 0.15 | 0.11 | Comp. |
| 16 | | | II-23 | 45 | 10.45 | 150 | A | 100 | 98 | 0.09 | 0.04 | Inv. |
| 17 | I-1 | 25 | II-19 | 20 | 10.15 | 300 | B | 100 | 96 | 0.2 | 0.22 | Comp. |
| 18 | I-1 | 25 | II-19 | 20 | 10.15 | 150 | D | 100 | 82 | 0.16 | 0.17 | Comp. |
| 19 | I-1 | 25 | II-19 | 20 | 10.45 | 300 | A | 100 | 106 | 0.14 | 0.1 | Comp. |
| 20 | I-1 | 25 | II-19 | 20 | 10.45 | 150 | A | 100 | 98 | 0.08 | 0.05 | Inv. |
| 21 | I-1 | 20 | II-23 | 20 | 10.15 | 300 | B | 100 | 96 | 0.21 | 0.23 | Comp. |
| 22 | I-1 | 20 | II-23 | 20 | 10.15 | 150 | D | 100 | 82 | 0.17 | 0.18 | Comp. |
| 23 | I-1 | 20 | II-23 | 20 | 10.45 | 300 | A | 100 | 105 | 0.15 | 0.11 | Comp. |
| 24 | I-1 | 20 | II-23 | 20 | 10.45 | 150 | A | 100 | 98 | 0.1 | 0.05 | Inv. |
| 25 | I-3 | 20 | II-19 | 20 | 10.15 | 300 | B | 100 | 95 | 0.2 | 0.22 | Comp. |
| 26 | I-3 | 20 | II-19 | 20 | 10.15 | 150 | D | 100 | 82 | 0.15 | 0.17 | Comp. |
| 27 | I-3 | 20 | II-19 | 20 | 10.45 | 300 | A | 100 | 105 | 0.14 | 0.1 | Comp. |
| 28 | I-3 | 20 | II-19 | 20 | 10.45 | 150 | A | 100 | 98 | 0.09 | 0.05 | Inv. |
| 29 | I-3 | 20 | II-23 | 20 | 10.15 | 300 | B | 100 | 95 | 0.21 | 0.23 | Comp. |
| 30 | I-3 | 20 | II-23 | 20 | 10.15 | 150 | D | 100 | 82 | 0.16 | 0.17 | Comp. |
| 31 | I-3 | 20 | II-23 | 20 | 10.45 | 300 | A | 100 | 106 | 0.14 | 0.12 | Comp. |
| 32 | I-3 | 20 | II-23 | 20 | 10.45 | 150 | A | 100 | 99 | 0.09 | 0.04 | Inv. |

Comp.: Comparative
Inv.: Inventive

As can be seen from the table, the invention led to an improvement in developed silver color to produce neutral black tone. It is noted that, even when developed at a low replenishing rate, inventive samples maintained sensitivities with little difference from the initial level. It is further noted that, even when developing temperature is varied, deterioration or fluctuation in γ gradation) and the maximum density were little and a stabilized photographic performance was achieved.

Example 2

Gelatin was dissolved in a reactor vessel containing 1 l of water kept at 53° C. and thereto was added 0.4 g of potassium bromide, 6 g of sodium chloride and 0.8 ml of 10% aqueous solution of polyisopropylene-polyethylene-disodium succininate and then further added 600 ml of an aqueous solution containing 100 g of silver nitrate and 600 ml of an aqueous solution containing 56 g of potassium bromide and 7 g of sodium chloride by a double jet method over a period of 25 minutes to form a core portion of the grain containing 20 mol % chloride. Thereafter, 500 ml of an aqueous solution containing 100 g of silver nitrate and 500 ml of aqueous solution containing 40 g of potassium bromide, 14 g of sodium chloride and potassium hexachloroiridate in an amount of $8\times10^{-7}$ mol were added over a period of 30 minutes by a double jet method to form a shell portion containing 40 mol % chloride. Thus prepared emulsion was proved to be comprised of monodispersed, cubic-shaped silver chlorobromide grains having an average grain size of 0.35 μm.

After the emulsion was dissolved immediately prior to chemical ripening and adjusted to be at a given temperature, sensitizing dyes as set forth in Table 2 was added to the emulsion and subjected to chemical ripening by adding thereto ammonium thiocyanate, chloroauric acid and sodium thiosulfate; and after completing chemical ripening, 4-hydroxy-1,3,3a,7-tetrazaindene was added. Thus prepared emulsion was used to prepare photographic material samples in the same manner as in Example 1. The coating weight of silver was 3.0 g/m², and as to gelatin amounts, were 3 g/m² for an emulsion layer and 1.2 g/m² for a protective layer.

Samples were subjected to exposure and processing, and evaluated in the same manner as in Example 1. Results thereof are summarized in Table 2.

TABLE 2

| Sample No. | Sensitizing dye Compd. No. | Sensitizing dye Amount (mg/Ag mol) | Sensitizing dye Compd. No. | Sensitizing dye Amount (mg/Ag mol) | Developer pH | Developer Replenisher (ml/m²) | Silver image tone | Sensitivity Initial | Sensitivity After running-processing | Processing stability Δγ | Processing stability ΔDm | Remarks |
|---|---|---|---|---|---|---|---|---|---|---|---|---|
| 33 | III-1 | 35 | | | 10.15 | 300 | B | 100 | 95 | 0.21 | 0.22 | Comp. |
| 34 | III-1 | 35 | | | 10.15 | 150 | D | 100 | 80 | 0.16 | 0.17 | Comp. |
| 35 | III-1 | 35 | | | 10.45 | 300 | A | 100 | 105 | 0.15 | 0.12 | Comp. |
| 36 | III-1 | 35 | | | 10.45 | 150 | A | 100 | 100 | 0.08 | 0.05 | Inv. |
| 37 | III-3 | 35 | | | 10.15 | 300 | B | 100 | 96 | 0.2 | 0.21 | Comp. |
| 38 | III-3 | 35 | | | 10.15 | 150 | D | 100 | 82 | 0.17 | 0.18 | Comp. |
| 39 | III-3 | 35 | | | 10.45 | 300 | A | 100 | 106 | 0.14 | 0.11 | Comp. |

TABLE 2-continued

| Sample No. | Sensitizing dye Compd. No. | Sensitizing dye Amount (mg/Ag mol) | Sensitizing dye Compd. No. | Sensitizing dye Amount (mg/Ag mol) | Developer pH | Developer Replenisher (ml/m²) | Silver image tone | Sensitivity Initial | Sensitivity After running-processing | Processing stability Δγ | Processing stability ΔDm | Remarks |
|---|---|---|---|---|---|---|---|---|---|---|---|---|
| 40 | III-3 | 35 | | | 10.45 | 150 | A | 100 | 100 | 0.09 | 0.05 | Inv. |
| 41 | III-6 | 35 | | | 10.15 | 300 | B | 100 | 95 | 0.2 | 0.22 | Comp. |
| 42 | III-6 | 35 | | | 10.15 | 150 | D | 100 | 83 | 0.15 | 0.16 | Comp. |
| 43 | III-6 | 35 | | | 10.45 | 300 | A | 100 | 106 | 0.14 | 0.12 | Comp. |

Comp.: Comparative
Inv.: Inventive

As can be seen from the table, inventive samples led to improved results in silver image tone and a stable processing performance.

Example 3

Samples were prepared in the same manner as in Example 1, except that sensitizing dyes represented by formula [IV] were used. Sensitometric evaluation was made for a 14×17 cm-sized sample exposed to semiconductor laser light (820 nm) through a wedge. Processing was conducted in the same manner as in Example 1, provided that a developer was replenished in amount as shown in Table 3 and an replenishing amount of a fixer was 400 ml/m². Developing temperature was 32° or 35° C. and other processing temperatures were the same as in Example 1. After processing 500 pieces of samples (10"×12" size) exposed to light so as to produce a density of 1.0, a sample was sensitometrically evaluated. Results thereof are shown in Table 3.

TABLE 3

| Sample No. | Sensitizing dye Compd. No. | Sensitizing dye Amount (mg/Ag mol) | Sensitizing dye Compd. No. | Sensitizing dye Amount (mg/Ag mol) | Developer pH | Developer Replenisher (ml/m²) | Silver image tone | Sensitivity Initial | Sensitivity After running-processing | Processing stability Δγ | Processing stability ΔDm | Remarks |
|---|---|---|---|---|---|---|---|---|---|---|---|---|
| 44 | III-6 | 35 | | | 10.45 | 150 | A | 100 | 100 | 0.09 | 0.04 | Inv. |
| 45 | IV-1 | 35 | | | 10.15 | 300 | B | 100 | 95 | 0.2 | 0.22 | Comp. |
| 46 | IV-1 | 35 | | | 10.15 | 150 | D | 100 | 81 | 0.15 | 0.16 | Comp. |
| 47 | IV-1 | 35 | | | 10.45 | 300 | A | 100 | 106 | 0.13 | 0.1 | Comp. |
| 48 | IV-1 | 35 | | | 10.45 | 150 | A | 100 | 98 | 0.1 | 0.05 | Inv. |
| 49 | IV-2 | 35 | | | 10.15 | 300 | B | 100 | 95 | 0.21 | 0.24 | Comp. |
| 50 | IV-2 | 35 | | | 10.15 | 150 | D | 100 | 82 | 0.16 | 0.15 | Comp. |
| 51 | IV-2 | 35 | | | 10.45 | 300 | A | 100 | 105 | 0.14 | 0.1 | Comp. |
| 52 | IV-2 | 35 | | | 10.45 | iso | A | 100 | 99 | 0.09 | 0.05 | Inv. |

Comp.: Comparative
Inv.: Inventive

As can be seen from the above Tables 2 and 3, inventive samples maintained sensitivities with little difference from the initial level, even after being heavily running-processed. It was shown that, even when developing temperature is varied, deteriorations or fluctuations in γ (gradation) and maximum density were little and a stabilized photographic performance was achieved.

Example 4

A silver iodobromide monodispersed, cubic crystal grain emulsion (A) containing 2 mol % iodide was prepared by a double-jet method while being controlled at a temperature of 60° C., a pAg of 8.0 and a pH of 2.0. The emulsion grains thus-prepared were further grown in a manner as follows.

In 8.5 l of aqueous solution containing gelatin and ammonia kept at 40° C., the above emulsion (A) was dispersed, and the pH thereof was adjusted by using acetic acid. To this solution (mother liquor), an ammoniacal silver salt solution (3.2 N) and a halide solution (2.5 N) containing potassium bromide and potassium iodide in a molar ratio of 65:35 were added by a double jet method, while being controlled at the pAg of 7.3 and the pH of 9.7. The emulsion grains were further grown at the pAg of 9.0 and with lowering the pH from 9.0 to 8.0. Thereafter, a 3.0N solution of potassium bromide was added thereto over a period of 8 min. to change the pAg to 11.0. After addition, stirring was further continued over a period of 3 min. Then the emulsion was subjected to flocilation washing to remove water-soluble salt according to a conventional method.

The resulting emulsion was shown to be comprised of silver iodobromide grains having an average grain size of 0.25 μm and containing internally high iodide of 35 mol % (an average overall iodide content of 1.0 mol %). After adding a spectral sensitizing dye as shown in Table 4, the emulsion was further subjected to chemical ripening by adding ammonium thiocyanate, chloroauric acid and sodium thiosulfate. After completing the chemical ripening, 4-hydroxy-1,3,3a, 7-tetrazaindene was added thereto.

Using the emulsion, photographic material samples No. 53 to 69 were prepared in the same manner as in Example 1, in which a silver coating weight was 3.0 g/m², and gelatin coating weight of silver halide emulsion layer and a protective layer were each 3.0 and 1.2 g/m². Samples were subjected to exposure and processing, and evaluated in the same manner as in Example 1. Results thereof are summarized in Table 4.

TABLE 4

| Sample No. | Sensitizing dye Compd. No. | Sensitizing dye Amount (mg/Ag mol) | Sensitizing dye Compd. No. | Sensitizing dye Amount (mg/Ag mol) | Developer pH | Developer Replenisher (ml/m²) | Silver image tone | Sensitivity Initial | Sensitivity After running-processing | Processing stability Δγ | Processing stability ΔDm | Remarks |
|---|---|---|---|---|---|---|---|---|---|---|---|---|
| 53 | I-1 | 45 | | | 10.15 | 150 | D | 100 | 81 | 0.20 | 0.22 | Comp. |
| 54 | I-1 | 45 | | | 10.45 | 150 | A | 100 | 98 | 0.04 | 0.05 | Inv. |
| 55 | I-1 | 45 | | | 10.45 | 100 | A | 100 | 97 | 0.05 | 0.05 | Inv. |
| 56 | II-19 | 45 | | | 10.15 | 150 | D | 100 | 81 | 0.20 | 0.22 | Comp. |
| 57 | II-19 | 45 | | | 10.45 | 150 | A | 100 | 98 | 0.04 | 0.05 | Inv. |
| 58 | II-19 | 45 | | | 10.45 | 100 | A | 100 | 97 | 0.05 | 0.05 | Inv. |
| 59 | I-1 | 25 | II-19 | 20 | 10.15 | 150 | D | 100 | 81 | 0.20 | 0.22 | Comp. |
| 60 | I-1 | 25 | II-19 | 20 | 10.45 | 150 | A | 100 | 99 | 0.04 | 0.05 | Inv. |
| 61 | I-1 | 25 | II-19 | 20 | 10.45 | 100 | A | 100 | 98 | 0.05 | 0.05 | Inv. |
| 62 | — | — | | | 10.45 | 150 | D | 100 | 79 | 0.25 | 0.22 | Comp. |
| 63 | I-4 | 30 | | | 10.45 | 150 | A | 100 | 98 | 0.05 | 0.05 | Inv. |
| 64 | I-4 | 45 | | | 10.45 | 150 | A | 100 | 98 | 0.05 | 0.05 | Inv. |
| 65 | III-1 | 35 | | | 10.15 | 100 | D | 100 | 81 | 0.20 | 0.23 | Comp. |
| 66 | III-1 | 35 | | | 10.40 | 100 | A | 100 | 97 | 0.03 | 0.02 | Inv. |
| 67 | III-3 | 35 | | | 10.15 | 100 | D | 100 | 88 | 0.15 | 0.20 | Comp. |
| 68 | III-3 | 35 | | | 10.45 | 100 | A | 100 | 98 | 0.02 | 0.03 | Inv. |
| 69 | III-3 | 35 | | | 10.60 | 100 | A | 100 | 99 | 0.02 | 0.03 | Inv. |
| 70 | IV-1 | 35 | | | 10.15 | 70 | D | 100 | 75 | 0.25 | 0.30 | Comp. |
| 71 | IV-1 | 35 | | | 10.45 | 70 | B | 100 | 92 | 0.08 | 0.10 | Inv. |
| 72 | IV-1 | 35 | | | 10.60 | 70 | A | 100 | 96 | 0.06 | 0.08 | Inv. |
| 73 | — | — | | | 10.60 | 50 | D | 100 | 70 | 0.43 | 0.50 | Comp. |
| 74 | IV-2 | 35 | | | 10.15 | 50 | D | 100 | 73 | 0.41 | 0.49 | Comp. |
| 75 | IV-2 | 35 | | | 10.45 | 50 | B | 100 | 90 | 0.10 | 0.10 | Inv. |
| 76 | IV-2 | 35 | | | 10.60 | 50 | B | 100 | 92 | 0.09 | 0.08 | Inv. |
| 77 | IV-3 | 35 | | | 10.15 | 150 | D | 100 | 80 | 0.20 | 0.22 | Comp. |
| 78 | IV-3 | 35 | | | 10.45 | 150 | A | 100 | 98 | 0.05 | 0.05 | Inv. |
| 79 | IV-3 | 35 | | | 10.45 | 100 | A | 100 | 97 | 0.05 | 0.05 | Inv. |

Comp.: Comparative
Inv.: Inventive

As can be seen from the table, inventive samples were slightly deteriorated in silver image tone little in sensitivity variation, even when running-developed at a low replenishing rate. It was noted that silver halide grains containing internally high iodide led to more advantageous results, as compared to the results of Examples 1 to 3.

What is claimed:

1. A method of processing, by use of an automatic processor, a silver halide photographic light-sensitive material comprising a support having thereon a silver halide emulsion layer, the method comprising the steps of developing an exposed photographic material with a developer, fixing the developed photographic material with a fixer, washing the photographic material and drying the photographic material, wherein said developer has a pH of 10.4 or more and is replenished by a developer replenisher at a rate of 50 to 220 ml/m² of photographic material, and wherein said silver halide emulsion layer contains a spectral sensitizing dye represented by Formula (IV), said silver halide emulsion containing a silver halide grains comprising silver iodobromide or silver iodochlorobromide and comprising a high silver iodide phase, in the central portion thereof, having an iodide content of 20 to 40 mol %

Formula [IV]

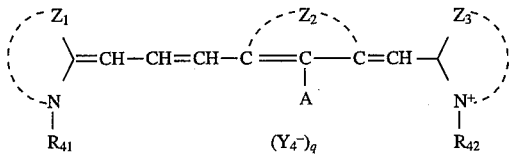

wherein $Z_1$ and $Z_3$ independently represent a nonmetallic atom group necessary for forming benzothiazole, benzooxazole, naphthothiazole or naphthooxazole, each of which may be substituted; $R_{41}$ and $R_{42}$ represent each a substituted or unsubstituted alkyl group; $Z_2$ represents a carbon atom group necessary for forming a 5- or 6-membered carbon ring; A represents a hydrogen atom or a substituent; $Y_4^-$ represents a counter ion; q is 0 or 1, provided that, when an intramolecular salt is formed, q is 0.

2. The method of claim 1, wherein said spectral sensitizing dye is contained in an amount of 0.005 to 1.0 g per mol of silver halide.

3. The method of claim 1, wherein said silver halide grains comprises a core having an iodide content of 20 to 40 mol % and a shell having an iodide content of 5 mol % or less.

4. The method of claim 1, wherein said photographic material is processed for a period of time of 25 to 45 seconds in total.

* * * * *